US005910035A

United States Patent [19]

Rebotier et al.

[11] Patent Number: 5,910,035

[45] Date of Patent: Jun. 8, 1999

[54] MEANS FOR RAISING ONE OR BOTH OF THE HEELS OF A SURFER

[76] Inventors: Thomas Rebotier, 8469 Paseo del Ocaso, La Jolla, Calif. 92037; Kyle A Cohn, 4619 Juniper La., Palm Beach Gardens, Fla. 33418

[21] Appl. No.: 08/880,753

[22] Filed: Jun. 23, 1997

[51] Int. Cl.[6] ..... B63B 35/79

[52] U.S. Cl. ..... 441/74; 114/39.2

[58] Field of Search ..... 441/68, 70, 74; 114/39.2

[56] References Cited

U.S. PATENT DOCUMENTS

| | | | |
|---|---|---|---|
| 4,129,911 | 12/1978 | McDonald et al. | 441/74 |
| 4,466,373 | 8/1984 | Prade et al. | 441/74 |
| 4,568,296 | 2/1986 | Newell | 441/70 |
| 4,840,590 | 6/1989 | Kelley | 441/74 |
| 4,902,256 | 2/1990 | Berglung | 441/74 |
| 5,308,271 | 5/1994 | Foulke | 441/74 |
| 5,385,494 | 1/1995 | Wilhelmi | 441/74 |
| 5,435,765 | 7/1995 | Fletcher | 441/74 |
| 5,454,743 | 10/1995 | Simonson | 441/74 |
| 5,460,558 | 10/1995 | Woodstock | 441/74 |
| 5,484,312 | 1/1996 | Zepeda | 441/74 |
| 5,529,523 | 6/1996 | Wilhelmi | 441/74 |

FOREIGN PATENT DOCUMENTS

A 30680/95 3/1996 Australia .

OTHER PUBLICATIONS

Block Surf Catalog, 1997, Thumbnail on relevant pages.
Surfer, Oct. 1997, Photographs in plates 1–3.
Water Ski, Sep.–Oct. 1997, Photographs in plates 4–5.

*Primary Examiner*—Jesus D. Sotelo

[57] ABSTRACT

The means for raising one heel or both heels of the surfer so that the resting position of the ankle is more extended than on a flat deck. Examples of these means are a foot pad (22) thicker on one side, an asymmetrical height given to the deck of the board (24) itself, or a wedge (14) inserted between the board (10) and the pad (12).

4 Claims, 4 Drawing Sheets

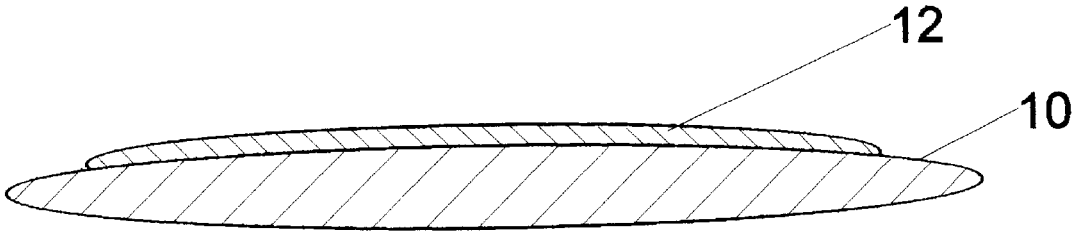
FIG 1.A
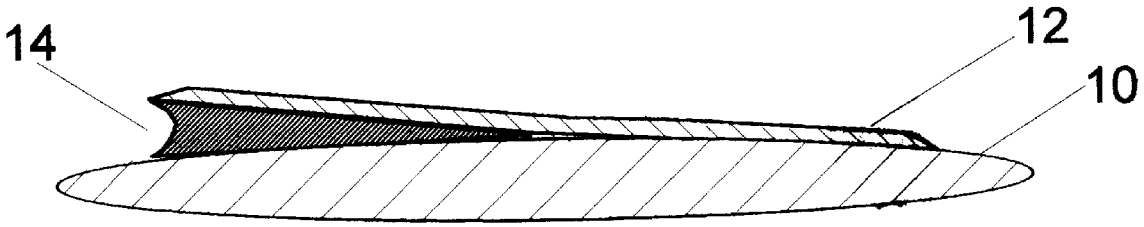
FIG 1.B

MEANS FOR RAISING ONE OR BOTH OF THE HEELS OF A SURFER

BACKGROUND

1. Field of Invention

This invention relates to surfboards and attachments to the deck of surfboards.

2. Discussion of Prior Art

Until the seventies, surfers surfed on boards called long boards, that are more stable and less manoeuvrable than modern boards, called short bards. On long boards, moving around on the board was critical to controlling the board. Because of the board size, one had to step up and down the board, and somewhat to the side, to produce a shift of weight large enough to make the board turn. Moreover, manoeuvres with these long boards had much less angle, especially vertically, that manoeuvres with modern, boards.

In 1970 surfing underwent what is called "the short board revolution". Surfers discovered that shorter boards could be turned easier and faster. Since then, many have sought over this concept, and adapted to shorter, thinner, narrower boards. Further improvements in fin size and placement (the "twin-fin", in 1980, and the tri-fin "thruster", in 1985) have led to the modern short board era.

Along with the increase in manoeuvers on the waves, the surfers have experienced a need for increased traction. This need was met by the invention of what is called the foot pad. The foot pad is used mostly for the back foot, although several brands also offer a front foot pad, never independently, but in addition to the back foot pad. The reasons for this are that (1) the back foot tends to slip more easily off the board, especially during the take-off, and (2) most turns, and hence, manoeuvres, are done by pivoting around the base of the board, because the surfer's weight is mostly on his back foot. Pat. No. 5529523, 5435765, and 5308271 present examples of foot pads.

In conjunction to the transition from long boards to short boards, good surfing has been more and more equated with a low, squatting stance. A low stance provides more static stability (given the same base it takes a bigger perturbation to throw off a surfer whose centre of gravity is lower). It also allows one to stand up, pushing the board down harder against the water, which gives better control at high speed during a manoeuvre. Finally, the ability to go back and forth from a high stance to a squatting stance is crucial for "pumping" the wave, which is a shuffling of the board up and down the face capturing much more of the wave's energy than just staying in trim.

Another consequence of the short board revolution is that board control has been equated more and more by angling the foot rather than moving on the board. This is because the ratio of the surfer's weight to the wet area of the board, and to the inertia momentums of the board are much higher on a short board than on a long board. Consequently, the surfer no longer needs to move his feet to shift his weight significantly. He only has to press down his heels or his toes to control the roll, and to move his weight from one foot to the other to control the pitch.

In summary, modern surfing requires a low stance, and necessitates control over the rotation around the longitudinal axis of the surfboard (roll). Some of this control can be achieved by moving the body weight dynamically, but most of the finer control comes from angling the feet with respect to the legs by flexing or extending one's ankles.

However, this kind of control is not symmetrical, because the flexibility of the ankle usually allows much more extension (pointing the toes down) than flexion (lifting the toes). This asymmetry becomes even more critical when the surfer is lowering his body, as the balanced posture with a low centre of gravity involves an ankle even more flexed.

Most performant surfers solve this problem by "tucking in the knee", that is, by flexing forward the back leg so that the back knee is pushed forward as much as possible. This movement is very bad physiologically, as it strains the knee join, trying to bend it along a degree of freedom that the join does not possess. In addition, this movement is only partially efficient, and low-squatting surfers can hardly flex their ankles.

No attempt of compensating for this problem has ever been made in the surfing community prior to the present invention:

Presently, surfboards have, if not a flat deck, a deck which falls off symmetrically from the longitudinal midline of the board. They are designed so that if the board is laid on a flat horizontal surface, there is substantially no slope across the longitudinal midline (that is, usually, across the stringer).

Foot pads commonly used by present surfers are as much as possible symmetrical with respect to the longitudinal midline, with minor exceptions of design which do not modify the symmetry of the slope with respect to the midline, and intend not to. Many foot pads feature with a central arch for comfort, or a raised footstop at the back of the pad, but this does not break the symmetry around the longitudinal midline. Some foot pads come in several pieces, and include symmetrical central pieces, plus pieces which are mirror-images of each other and are placed on the deck of the board symmetrically around the stringer. The sole surface often features stripes or bumps, which are local variations in pad thickness. Although these stripes or bumps are not necessarily symmetrical with respect to the midline, their small scale makes them a texture and, when stepped on, they introduce no substantial deviation from the horizontal. Surfers do not either put other attachments between the deck of the board and the pad. In summary, before and up to the present invention, the foot pad is designed and used in the surfing community as a means of improving traction, but never to raise one's heels over one's toes.

Wax covers the surfboards in a thin layer or in little mounts called "wax bumps". Wax is applied as uniformly as possible, and in the case of making wax bumps, they are spread uniformly over the areas where the feet will rest, thus introducing no lateral slant or step to the deck.

A list of several patents relevant for the background is given below in Table 1. As illustrated in that table, there are many variations in foot pad shape, but none of them considers a change in height that would be asymmetrical with respect to the longitudinal midline. Planar symmetry with respect to the stringer is an implicit rule of board design, broken very rarely and then only in the outline of the board, not in its thickness. Indeed common sense dictates that good balance is more easily achieved on a horizontal surface. Since the coming of age of the short board (1969), good surfing has been more and more equated with a low, squatting stance, and board control has been equated more and more by angling the foot rather than moving on the board. The fact that the constraints of squatting low on a board make a non-horizontal support surface better for balance has eluded the attention of the whole surfing community for now twenty-eight years. Moreover, in the surfing community, the foot pad has always been conceived as a traction device and never had the role of an ergonomic balance improver.

TABLE 1 a list of relevant patents (from the Official Gazette)

| Patent Number | Patent Title | Our Comment |
|---|---|---|
| 5529523 | Foot brace and leveraged turning apparatus for surfboards | "Standard" traction pad, symmetrical with respect to the longitudinal midline, especially in height. |
| 5484312 | Surfboard foot piece | A foot piece to wrap over the foot. Does not lift the heel nor lower the toe. |
| 5460558 | Surfboard foot saddle | U-shaped piece that goes behind and around the foot, not under it. |
| 5454743 | Free style surfboard with removable foot pieces | The invention covers the means of attachment of the foot pieces. The foot pieces described have no asymmetry in height with respect to the longitudinal midline |
| 5435765 | Surfboard pad | Symmetrical surfboard pad made of three pieces. The central piece is elevated symmetrically with respect to the longitudinal midline of the board, and fits in the arch of the foot for comfort and better traction. Nothing in this invention addresses the issue of raising the surfer's heel. |
| 5385494 | Foot brace and leveraged turning apparatus for surfboards | This patent covers a indenture in the board which is symmetrical with respect to the longitudinal midline board. |
| 5308271 | Non-sip design pad for surfboard and method | Is made of a sheet of uniform thickness, except for possible bumps or stripes uniformly distributed over the sheet. Cannot substantially raise the heel or lower the toe. |
| 4840590 | Surfboard traction bar | a traction bar explicitly under the arches, not the heels, of the surfer's feet. |
| 4466373 | Foot loops for surfboard | Other mean of traction than a foot pad. Nothing under the foot that could raise the heel. |
| 4129911 | Soft deck surfboard | The deck is soft but shaped with symmetry with respect to the longitudinal midline. The softness would cause, if anything, the heels to sink lower than the toes. |

OBJECT AND ADVANTAGES

The object of the invention is to raise substantially one or both of the heels of the surfer.

The advantages all stem from the fact that with a raised heel, the range of ankle flexion is increased at the expense of the range of ankle extension. Since ankle extension has naturally a much higher range than ankle flexion, and since modern surfing actually requires more flexion than extension, several substantial advantages can be derived:

(a) the surfer can squat lower on his board with equal knee tucking, (b) the surfer can spare his knee even though he squats, (c) independently of the knee strain involved, the physiology of flexion makes it easier to flex when the heel is supported, so that the squatting requires less leg strength, (d) the range of ankle flexion still available is higher, allowing much better control of the board during the ride, These four advantages combine to make the invention very desirable for both high-performance and beginning surfers.

DRAWING FIGURES

FIG. 1.*a* shows the board without the invention

FIG. 1.*b* shows the board with one particular embodiment of the invention: using a wedge.

REFERENCE NUMERALS IN DRAWINGS

Figure 2:
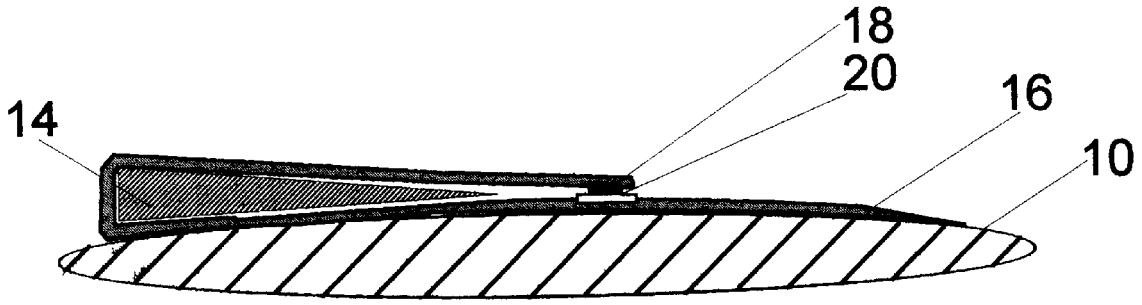
FIG. 2 shows the cross-section of board where the wedge is enclosed rather than just attached.

10 Body of surfboard
12 Flexible foot pad of standard issue
14 Wedge inserted between the surfboard and the foot pad
16 Foot pad wrapping around wedge
18 Strip of female Velcro
20 Strip of male Velcro
22 Foot pad with asymmetrical thickness
24 Body of surfboard with asymmetrical shape.

DESCRIPTION OF FIGS. 1–4

FIG. 1.*a* illustrates the state of the art practice prior to the invention: the attachment to the deck of the surfboard 10 is a foot pad 12, and it is a traction device and secondarily a cushioning device. It is as thin as possible as its function of traction and cushion will allow.

FIG. 1.*b* illustrates the improvement that the invention brings. With the same foot pad, a wedge 14 now provides the asymmetrical raise. This particular wedge features a lateral channel for better water flow.

FIG. 2 shows another variation of the foot pad plus wedge embodiment. To allow easy and frequent changes of the wedge, it is enclosed rather than attached. This is done by having the pad 16 wrap around it. The pad itself is attached on one side by glue, and on the other side by a removable attachment such as Velcro 18, 20.

Figure 3:
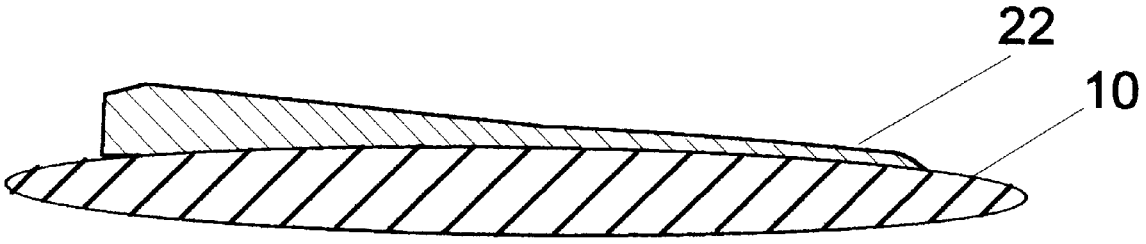
FIG. 3 shows the cross-section of board equipped with a foot pad with asymmetrical height.

FIG. 3 shows that the raise does not necessitate a separate wedge. It can be obtained by other means, in this Figure by a particular shape of the foot pad 22.

Figure 4:
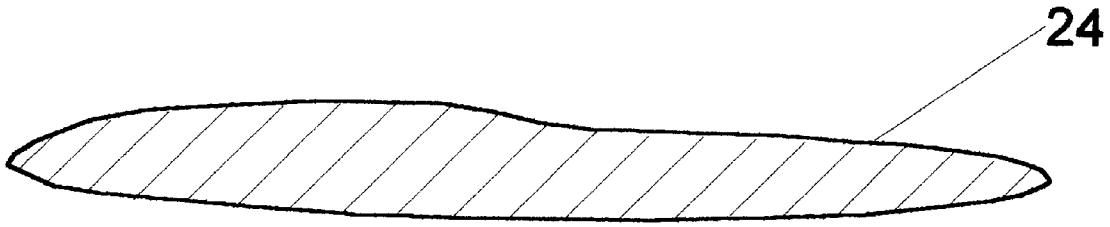
FIG. 4 shows the cross-section of board with a modified shape to produce the desired raise.

FIG. 4 illustrates that the invention can be also embodied by ere change in the shape of the board 24 itself.

SUMMARY

The invention concerns the means for raising the one heel or both heels of the surfer so that the resting position of the ankle is more extended than on a flat deck. Examples of these means are a foot pad thicker on one side, an asymmetrical height given to the deck of the board itself, or a wedge inserted between the board and the pad.

DESCRIPTION OF INVENTION

This invention covers the means for raising substantially the heels of the surfer or lowering his toes so that the resting position of the ankle is more extended than on a flat deck. Especially, the invention proposes improvements on the surfboard or on attachments made to the surfboard, so that the surface on which the surfer steps is no longer symmetrical in height with respect to the longitudinal midline of the board. These improvements or attachments will compensate partly or totally (or if needed overcompensate) the asymmetry of angle between ankle flexion and extension. The invention includes, for example, the insertion of a wedge between the deck of the surfboard and the foot pad, under the heel side only. Another example is that the foot pad can be made thicker on one side only (the heel side). Yet another way is to shape the surfboard so that one side is thicker than the other at various places where the surfer is likely to put the heel of his feet.

EXAMPLE OF EMBODIMENT

The invention and its operation is further illustrated by the two tests described hereafter.

The invention was reduced to practice by its inventors on two separate surfboards, and tested. In each of these two particular cases, the invention was reduced to practice by inserting a wedge made of closed-cells polystyrene foam, between the board and a commercial foot pad. The wedge was shaped from commercial closed-cell polystyrene foam with standard abrasive tools. It was then glued onto the board with a standard commercial glue (silicon glue). The left half of the pad was then glued onto the wedge using either silicon glue (board A) or super glue (board B). Had the surfers been "goofy foot", that is, surfers putting their left foot in the back, we would have put the wedge under the right half of the board. As it was, the surfers being "regular foot" (putting their right foot back), the wedge had to be put on the left to raise the heel of their back foot. In this particular cases, no modification of the standard posture was used on the front foot.

The first board, board A, was used by Thomas Rebotier. T. R. has only three years of experience with surfing short boards, which puts him at an "advanced beginner" level. In this particular case, the wedge was designed with a maximal thickness of 32 mm and had a single slope from one side to another. This extreme raise was made with the intent of having an instantaneous extreme effect on the surfer's ability.

The results testing this board were staggering. T. R. could squat all the way down on his board, which gave him a stability that he had never experienced until then. His evolution on the wave turned from shy, half completed moves to decent, full-angle turns. The invention allowed him to balance easier, giving him longer rides.

The second board, board B, was used by Kyle Cohn. K. C. is a professional surfer, nominated "East Coast Rookie of the year" in 1996 by the A.S.P. (Association of Surfing Professionals). K. C. competes successfully on WQS contests (World Qualifier Series). In college, he has won two East Coast collegiate titles and the NSSA (National Scholastic Surfing Association) conference. Because K. C. did not want to disturb his surfing too radically in a period of frequent contests, he opted for a thickness of only 10 mm, and also planed the forward quarter of the wedge down and forward, to avoid a sudden step between the front of the raised pad and the deck of the board.

Upon testing, K. C. immediately noticed a major increase in responsiveness. He was able to turn faster and sharper frontside (the front of the body facing the wave). Backside (the back of the body facing the wave), he was able to turn sharper on the bottom turn (first turn at the bottom of the wave, very important), thus getting more radical and critical manoeuvres throughout the rides The testing by K. C. is on videotape and several independent observers, on the beach and watching the tape, have concluded that Kyle indeed surfs better with the raised heel pad. In a contest held on the fourth day of testing, K. C. reached the finals by beating several surfers of higher WQS ranking.

We claim:

1. A foot pad substantially thicker on one side than on the other, and such that there exist a vertical section running from one lateral edge of said pad to the other, said section intersecting but not necessarily orthogonal to the longitudinal midline of said pad, said line of section being such that along the half of said section running from said midline to the edge of said pad on the thinner half of the pad, the thickness of said pad is substantially non-increasing from said midline to said edge.

2. In a surfboard including a deck surface, means for substantially raising at least one heel of a surfer; said means for raising being positioned on said deck surface such that at any vertical section transverse to the longitudinal axis of said surfboard a first portion of said means for raising is incrementally thicker from said longitudinal axis towards an edge of said deck surface and a second portion of said means for raising extending from said longitudinal axis to the edge of the surfboard having a non-increasing thickness.

3. Means for raising of claim 2 which are attachments to the deck of said surfboard.

4. Attachments of claim 3 which are foot pads.

* * * * *